US010587069B2

(12) United States Patent
Washio et al.

(10) Patent No.: US 10,587,069 B2
(45) Date of Patent: Mar. 10, 2020

(54) JOINT CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kazuhiro Washio, Mie (JP); Yasuo Omori, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 259 days.

(21) Appl. No.: 15/736,063

(22) PCT Filed: Jun. 3, 2016

(86) PCT No.: PCT/JP2016/066648
§ 371 (c)(1),
(2) Date: Dec. 13, 2017

(87) PCT Pub. No.: WO2016/208365
PCT Pub. Date: Dec. 29, 2016

(65) Prior Publication Data

US 2018/0159265 A1 Jun. 7, 2018

(30) Foreign Application Priority Data

Jun. 26, 2015 (JP) ..... 2015-128622

(51) Int. Cl.
*H01R 31/08* (2006.01)
*H01R 13/46* (2006.01)
(Continued)

(52) U.S. Cl.
CPC ..... *H01R 13/5045* (2013.01); *H01R 13/4361* (2013.01); *H01R 13/46* (2013.01);
(Continued)

(58) Field of Classification Search
CPC ..... H01R 13/46; H01R 13/4361; H01R 13/5045; H01R 2107/00; H01R 24/48;
(Continued)

(56) References Cited

U.S. PATENT DOCUMENTS 5,061,196 A * 10/1991 Weston ..... H01R 31/08 439/189
5,352,129 A * 10/1994 Guglhor ..... H01R 13/7032 439/188
(Continued)

FOREIGN PATENT DOCUMENTS

JP 6-2574 1/1994
JP 8-180923 7/1996
(Continued)

OTHER PUBLICATIONS

International Search Report dated Aug. 23, 2016.

*Primary Examiner* — James Harvey
*Assistant Examiner* — Paul D Baillargeon
(74) *Attorney, Agent, or Firm* — Gerald E. Hespos; Michael J. Porco; Matthew T. Hespos

(57) ABSTRACT

A joint connector includes a connector conductor part and an insulating housing for holding the connector conductor part and wire-side terminals to be connected to the connector conductor part. The insulating housing includes an outer wall (45) enclosing an accommodation space for accommodating wire-side terminals and separation walls dividing the accommodation space into terminal accommodating chambers (41). The separation walls include first separation walls (71) between the terminal accommodating chambers for
(Continued)

respectively accommodating the wire-side terminals to be insulated without being shorted to each other and second separation walls (72) interposed between the terminal accommodating chambers for respectively accommodating the wire-side terminals to be shorted to each other. The first and second separation walls (71, 72) are shaped so that outer ends (71*a*) of the first separation walls (71) and outer ends (72*a*) of the second separation walls (72) are different in appearance.

6 Claims, 9 Drawing Sheets

(51) Int. Cl.

| | |
|---|---|
| ***H01R 107/00*** | (2006.01) |
| ***H01R 24/28*** | (2011.01) |
| ***H01R 13/516*** | (2006.01) |
| ***H01R 13/504*** | (2006.01) |
| ***H01R 13/436*** | (2006.01) |
| ***H01R 13/52*** | (2006.01) |

(52) U.S. Cl.
CPC ..... *H01R 13/521* (2013.01); *H01R 31/08* (2013.01); *H01R 13/516* (2013.01); *H01R 24/28* (2013.01); *H01R 2107/00* (2013.01); *H01R 2201/26* (2013.01)

(58) Field of Classification Search
CPC .... H01R 13/516; H01R 31/08; H01R 13/521; H01R 2201/26; H01R 13/7031; H01R 13/7034
USPC ..... 439/721, 723
See application file for complete search history.

(56) References Cited

U.S. PATENT DOCUMENTS

| | | | | |
|---|---|---|---|---|
| 5,403,204 | A * | 4/1995 | Chishima ..... | H01R 13/4223 439/189 |
| 5,738,549 | A * | 4/1998 | Laquerbe ..... | H01R 13/4361 439/724 |
| 2009/0042445 | A1 | 2/2009 | Ichio et al. | |

FOREIGN PATENT DOCUMENTS

| | | |
|---|---|---|
| JP | 2009-54473 | 3/2009 |
| JP | 2014-49399 | 3/2014 |
| JP | 2014-165048 | 9/2014 |

* cited by examiner

JOINT CONNECTOR

BACKGROUND

Field of the Invention

The invention relates to a joint connector for electrically shorting a plurality of wires included in a wiring harness of an automotive vehicle or the like to each other.

Description of the Related Art

Known joint connectors are used for shorting specific wires in a wiring harness of an automotive vehicle to one another. For example, Japanese Unexamined Patent Publication No. 2014-49399 discloses a joint connector with a relay busbar and a housing for holding the relay busbar. The relay busbar integrally includes male terminals arranged in a specific direction and a coupling extending in the specific direction and coupling the male terminals. The housing includes a relay for holding the coupling of the relay busbar and a female terminal holding portion for holding female terminals to be fit respectively to the male terminals of the relay busbar. The interior of the female terminal holding portion is divided into accommodation spaces. Each accommodation space is open to the outside of the housing, and each female terminal is inserted individually into the accommodation space.

The relay busbar of the above-described joint connector is for shorting all of the terminals connected to the relay busbar to each other. In some other types of joint connectors, the relay busbar is arranged so that only some of terminals belonging to a specific group of the terminals are shorted, and the terminals not belonging to the same group are insulated without being shorted to each other. However, the shape of the relay busbar is difficult to see from the outside of the housing. Thus, if accommodation spaces for accommodating the respective female terminals are arranged orderly without any distinction and are open to the outside of the housing like the joint connector described in Japanese Unexamined Patent Publication No. 2014-49399, it is difficult for a worker to judge which female terminal should be inserted into each accommodation space and the worker may insert the female terminal different from the one that originally is supposed to be inserted, into the accommodation space. Such erroneous insertion may lead to the short-circuiting of the female terminals that are not supposed to be shorted.

To avoid this erroneous insertion, thought has been given to applying marks to an outer surface of the housing to enable distinction of the accommodation spaces by visual confirmation. This approach leads to more man hours and higher cost. Thought also has been given to make intervals between the terminals belonging to mutually different groups extremely larger than intervals between the terminals belonging to the same group. This approach has an inconvenience of enlarging the entire connector The invention aims to provide a joint connector that shorts specific wire-side terminals to each other while preventing erroneous short-circuiting caused by erroneous insertion of the wire-side terminals without drastically enlarging the entire connector and leading to a drastic cost increase.

SUMMARY

The invention is directed to a joint connector to be connected to wire-side terminals respectively mounted on wires for shorting specific wire-side terminals to each other. The joint connector includes a connector conductor part to be connected electrically to each wire-side terminal, and an insulating housing for holding the connector conductor part and each wire-side terminal to be connected to the connector conductor part. The connector conductor part includes three or more connector-side terminals arranged in a specific terminal arrangement direction and electrically connectable to the wire-side terminals by being fit to the wire-side terminals. A shorting connecting portion connects some of the connector-side terminals to each other to make those connector-side terminals electrically conductive to each other. The insulating housing includes a conductor holding portion for holding the connector conductor part and a terminal holding portion for receiving and holding each wire-side terminal to be fit to each connector-side terminal of the connector conductor part. The terminal holding portion includes an outer wall enclosing an accommodation space for accommodating the wire-side terminals, and separation walls dividing the accommodation space inside the outer wall into terminal accommodating chambers into which the respective wire-side terminals are individually insertable. Each separation wall has an outer end defining a terminal insertion opening for the wire-side terminal. The separation walls include a first separation wall interposed between adjacent terminal accommodating chambers adjacent to each other and configured to accommodate the wire-side terminals. Thus, the wire side terminals are insulated without being shorted to each other. A second separation wall is interposed between the terminal accommodating chambers adjacent to each other and configured to accommodate the wire-side terminals to be shorted to each other via the shorting connecting portion. The first and second separation walls are shaped to make an appearance of an outer end of the first separation wall and that of an outer end of the second separation wall different.

DETAILED DESCRIPTION

Figure 1:
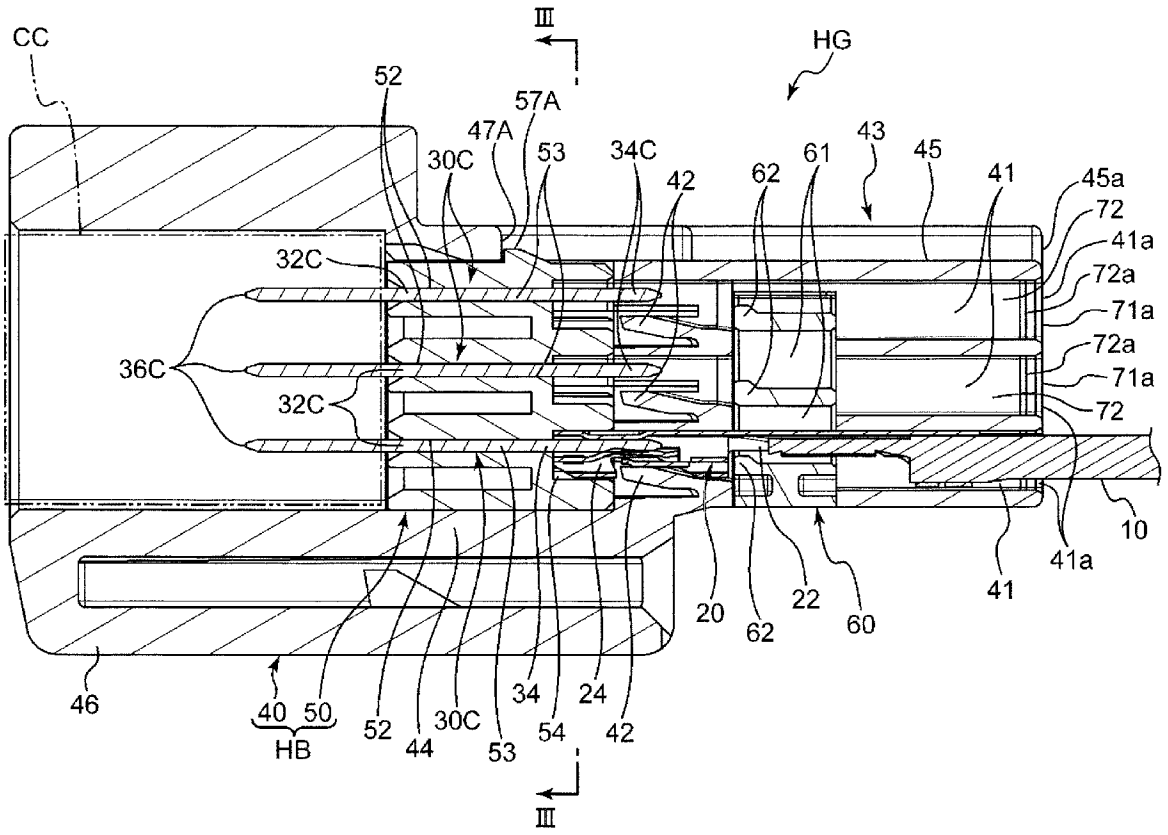
FIG. 1 is a side view in section along I-I of FIG. 2 of a joint connector according to a first embodiment of the present invention.

FIGS. 1 to 7 show a joint connector according to a first embodiment of the invention. This joint connector has a function of shorting specific wire-side terminals 20 to each other, and thereby shorts the wires 10 to which the specific wire-side terminals 20 are connected. The joint connector includes a plurality of connector conductor parts and an insulating housing HG.

Each of the wire-side terminals 20 is a female terminal formed of a single metal plate and includes a wire crimping portion 22 and an electrical contact portion 24. The wire crimping portion 22 is be crimped to the end of the wire 10 to enable electrical conduction between the wire-side terminal 20 and a connector conductor part of the wire 10. The electrical contact portion 24 receives a male terminal fit therein.

The connector conductor part is arranged in each of a plurality of stages (three stages in FIG. 1) located one above another. Each connector conductor part includes male terminals arranged in a predetermined terminal arrangement direction (parallel to a connector lateral direction in this embodiment) and shorting connecting portions for connecting specific male terminals to make the specific male terminals electrically conductive to each other.

Each connector conductor part is composed of shorting members 30A, 30B and 30C. Each shorting member 30A to 30C i a single member formed of a conductor (specifically, a flat metal plate). The shorting member 30A integrally includes a base 32A extending in the terminal arrangement direction, two first male terminals 34A projecting from the base 32A in a first projecting direction perpendicular to the terminal arrangement direction and two second male terminals 36A projecting from the base 32A in a second projecting direction opposite to the first projecting direction. Similarly, the shorting member 30B integrally includes a base 32B extending in the terminal arrangement direction, three first male terminals 34B projecting from the base 32B in the first projecting direction and three second male terminals 36B projecting from the base 32B in the second projecting direction. The shorting member 30C integrally includes a base 32C extending in the terminal arrangement direction, three first male terminals 34C projecting from this base 32C in the first projecting direction and three second male terminals 36C projecting from the base 32C in the second projecting direction.

The shorting members 30A, 30B and 30C are arranged in each stage such that the first male terminals 34A, 34B and 34C thereof are arranged in this order at equal intervals along the terminal arrangement direction and the second male terminals 36A, 36B and 36C thereof are arranged in this order along the terminal arrangement direction. Out of these shorting members 30A to 30C, the first male terminals 34A, 34B and 34C are arranged at equal intervals along the terminal arrangement direction to constitute a plurality of (eight in this embodiment) connector-side terminals that fit respectively to the electrical contacts 24 of the wire-side terminals 20. The base 32A defines the shorting connecting portion that connects the two first male terminals 34A to each other and makes the two first male terminal portions 34A electrically conductive to each other. Similarly, the base 32B defines the shorting connecting portion that connects the three first male terminals 34B to each other and makes the three first male terminal portions 34B electrically conducive to each other. Still further, the base 32C defines the shorting connecting portion that connects the three first male terminals 34C to each other and makes the three first male terminal portions 34C electrically conductive to each other.

Figure 2:
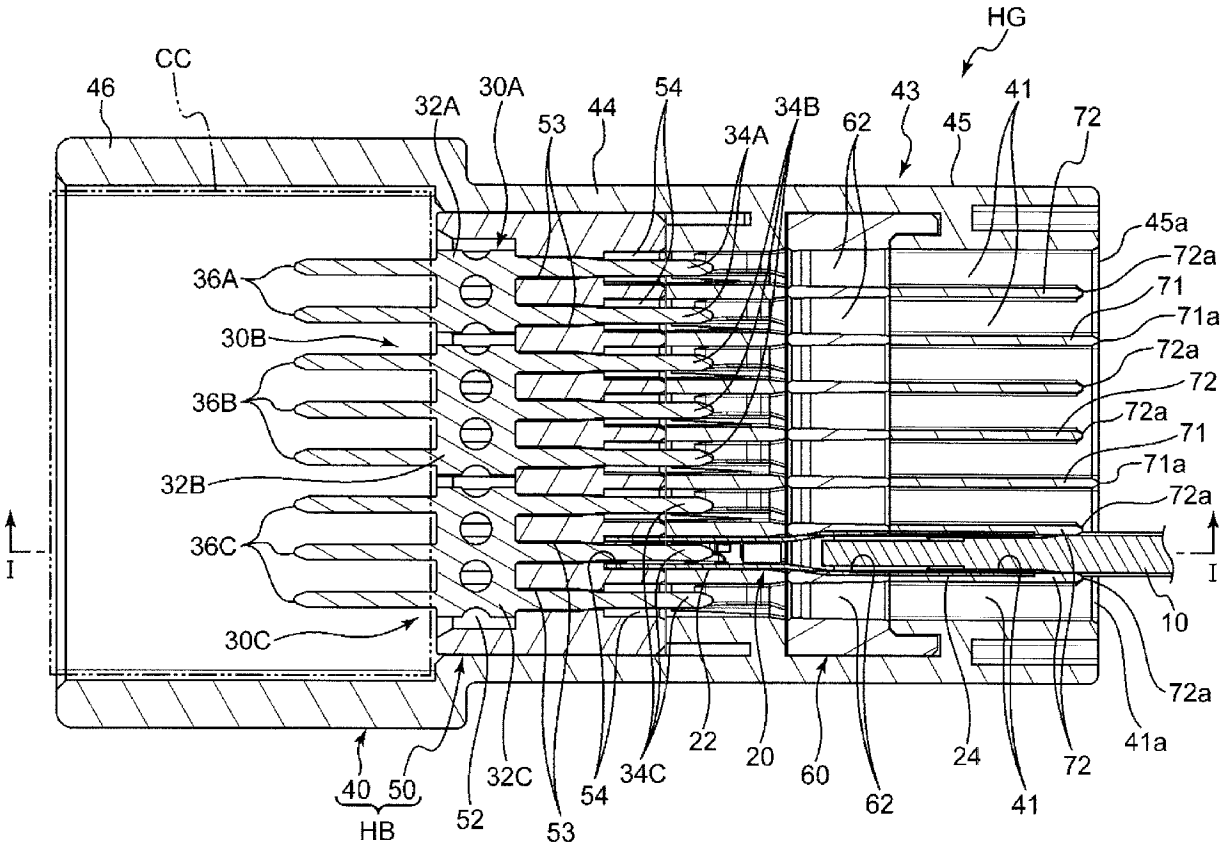
FIG. 2 is a plan view in section along II-II of FIG. 1.
Figure 3:
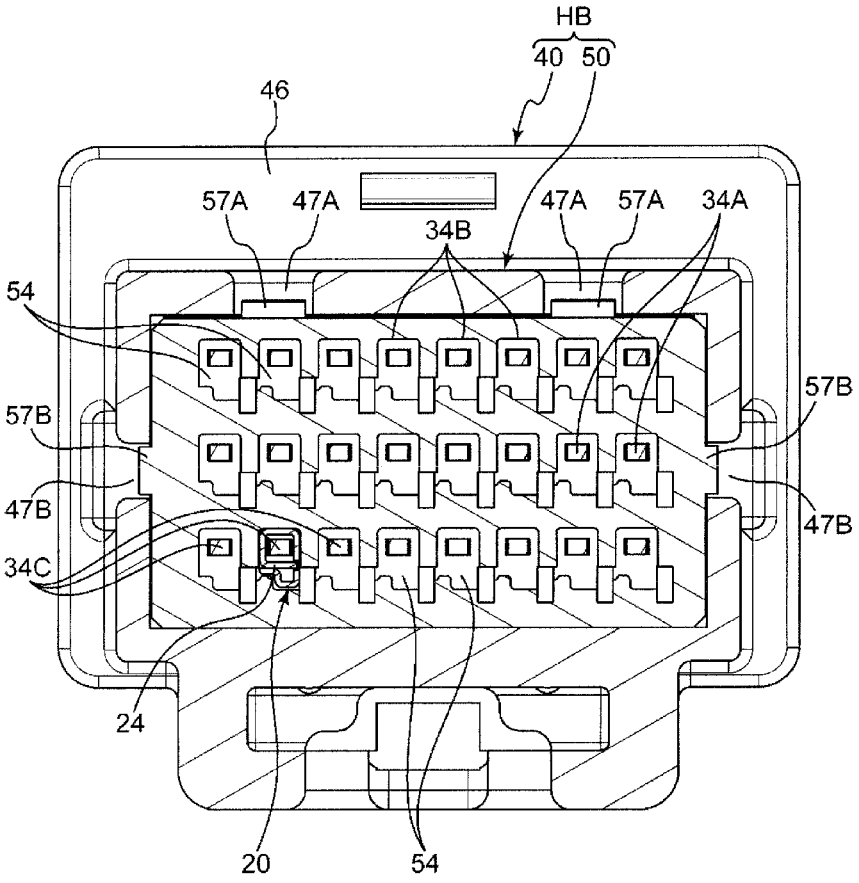
FIG. 3 is a front view in section along III-III of FIG. 1.
Figure 4:
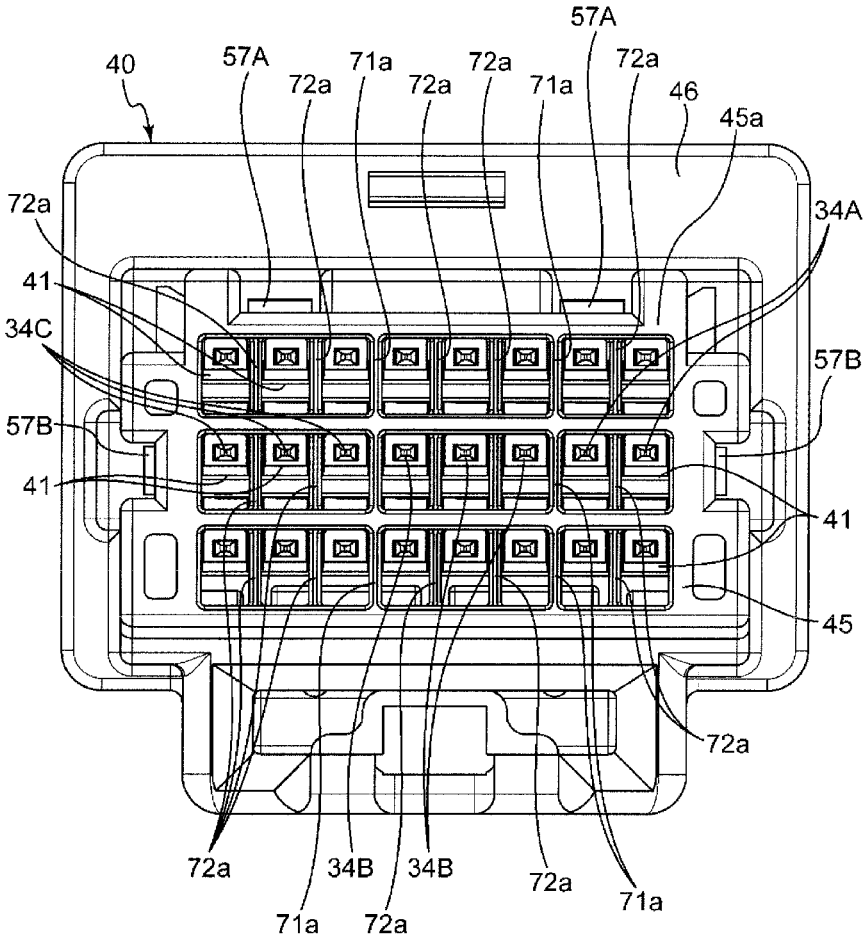
FIG. 4 is a back view of the joint connector viewed from the side of a receptacle.

The second male terminals 36A, 36B and 36C are shaped to fit in a fitting direction to connector terminals in a mating connector CC provided on an end of a wire bundle different from the wires 10 and shown by chain double-dashed line in FIGS. 1 and 2. In the present invention, the second male terminals 36A to 36C can be omitted as appropriate.

The insulating housing HG includes a housing body HB and a retainer 60 to be mounted into the housing body HB. The housing body HB includes a conductor holding portion 50 for holding the shorting members 30A to 30C constituting the connector conductor parts and an outer portion 40 for accommodating this conductor holding portion 50.

The conductor holding portion 50 has a substantially rectangular parallelepiped shape in this embodiment. This conductor holding portion 50 holds specific parts of the shorting members 30A to 30C. More particularly, the conductor holding portion 50 holds the bases 32A to 32C and base end parts of the first male terminals 34A to 34C of the shorting members 30A to 30C so that the shorting members 30A, 30B and 30C are arranged in this order in each of the stages located one above another and the respective shorting members 30A to 30C penetrate through the conductor holding portion 50 in a direction parallel to axial directions of the wire-side terminals 20.

The conductor holding portion 50 includes a base press-fit portion 52, terminal insertion holes 53 and terminal receiving recesses 54. The base press-fit portion 52 is open toward a receptacle 46 in the outer portion 40 and is configured to receive the bases 32A to 32C of the respective shorting members 30A to 30C fit therein from the side of the receptacle 46. The terminal insertion holes 53 communicate with the base press-fit portion 52 and are configured to receive the respective male terminals 34A to 34C press-fit therein. The terminal receiving recesses 54 are configured to receive the electrical contacts 24 of the wire-side terminals 20 to be fit respectively to the first male terminals 34A to 34C.

The outer portion 40 includes a casing 44, a terminal portion 43 and the receptacle 46.

The casing 44 accommodates and holds the conductor holding portion 50. Specifically, the casing 44 is interposed between the terminal holding portion 43 and the receptacle 46 and holds the conductor holding portion 50 to surround the conductor holding portion 50 in such an orientation that the respective second male terminals 36A to 36C project toward the receptacle 46 while the respective first male terminals 34A to 34C project toward the terminal holding portion 43. Constrained portions 57A, 57B to be constrained by the casing 44 are provided at suitable positions on the outer peripheral surface of the conductor holding portion 50. The casing 44 includes constraining portions 47A, 47B for constraining the respective constrained portions 57A, 57B.

The outer portion 40 and the conductor holding portion 50 may be molded integrally as a single member.

The receptacle 46 surrounds the respective second male terminals 36A to 36C projecting from the conductor holding portion 50 and receives a housing of the mating connector CC inserted therein. Specifically, this receptacle 46 constitutes a connector part connectable to the mating connector CC together with the respective second male terminals 36A to 36C. Thus, this receptacle 46 can be omitted in the present invention, similar to the second male terminals 36A to 36C.

The terminal holding portion 43 receives and holds the wire-side terminals 20 to be fit to the first male terminals 34A to 34C of the respective connector-side terminals in the shorting members 30A to 30C. This terminal holding portion 43 includes an outer wall 45, separation walls and locking lances 42.

The outer wall 45 has a substantially rectangular tube shape and encloses an accommodation space for accommodating the wire-side terminals 20. The separation walls are arranged in a direction parallel to the terminal arrangement direction while being spaced from each other and divides the accommodation space inside the outer wall 45 into terminal accommodating chambers 41 into which the respective wire-side terminals can be inserted. In this embodiment, the connector conductor parts are composed of the shorting members 30A, 30B and 30C as described above, and are arranged in the three stages located one above another. Thus, the terminal accommodating chambers 41 corresponding to the respective first male terminals 34A to 34C are arranged in vertical and horizontal directions shown in FIGS. 4 and 5 and are arranged at equal intervals (i.e. intervals between center axes of the terminal accommodating chambers 41 adjacent in the terminal arrangement direction are constant) in the horizontal direction, i.e. the terminal arrangement direction.

Each terminal accommodating chamber 41 extends in a terminal inserting direction parallel to the first projecting direction and is shaped to receive the wire-side terminal 20 inserted along the terminal inserting direction. An outer end of each terminal accommodating chamber 41 in the terminal inserting direction has a terminal insertion opening 41*a* serving as an insertion entrance for the wire-side terminal 20. Each wire-side terminal 20 can be inserted into the corresponding terminal accommodating chamber 41 through the terminal insertion opening 41*a* thereof with the electrical contact portion 24 in the lead and fit to the first male terminal portion 34A, 34B or 34C. The separation walls are described later.

Each locking lance 42 has a terminal locking portion for locking (primarily locking) the wire-side terminal 20 inserted into each terminal accommodating chamber 41. Each locking lance 42 is cantilevered from a base connected to a wall of the terminal accommodating chamber 41 to a tip opposite to the base, as shown in FIG. 1. This locking lance 42 is resiliently deformable such that the tip is displaced in a direction (down in FIG. 1) perpendicular to the axial direction of the wire-side terminal 20. The locking lance 42 allows the wire-side terminal 20 to be inserted into the terminal accommodating chamber 41 as the tip is displaced in a direction to retract from the wire-side terminal 20 (up in FIG. 1), while locking (primarily locking) the wire-side terminal 20 in the terminal accommodating chamber 41 as the tip resiliently returns when the wire-side terminal 20 is inserted completely in the terminal accommodating chamber 41. Specifically, the tip of the locking lance 42 engages a suitable part (intermediate part of the electrical contact 24 in an example of FIGS. 4 and 5) of the inserted wire-side terminal 20, thereby impeding separation of the wire-side terminal 20.

The retainer 60 is mounted into a suitable part of the terminal holding portion 43 to lock (secondarily lock) the wire-side terminals 20 inserted into the respective terminal accommodating portions 41 in the terminal holding portion 43 in addition to locking by the locking lances 42. Specifically, this retainer 60 is shaped to define windows 61 and each window 61 constitutes a specific part of each terminal accommodating portion 41 behind the locking lance 42. The retainer 60 includes locking projections 62 for respectively locking the specific parts (rear ends of the wire crimping portions 22 in FIG. 1) of the wire-side terminals 20 inserted into the respective terminal accommodating portions 41.

This retainer 60 is movable between a locking position shown in FIG. 1 where the locking projections 62 lock the wire-side terminals 20 and a passage permitting position displaced from the locking position in a mounting/detaching direction (direction perpendicular to the axial directions of the wire-side terminals 20 in this embodiment; down in FIG. 1). At the passage permitting position, each window 61 is aligned with another part of the corresponding terminal accommodating portion 41. Thus, the electrical contact 24 of the wire-side terminal 20 is permitted to pass through the window 61 (i.e. penetrate through the retainer 60) and to be fit to the first shorting-side terminal portion 34A to 34C.

The retainer 60 can be omitted as appropriate in the present invention.

Next, the separation walls included in the terminal holding portion 43 are described.

The separation walls define the terminal accommodating chambers 41 arranged in the terminal arrangement direction by being arranged at intervals (equal intervals in this embodiment) in the direction parallel to the terminal arrangement direction in each of the stages located one above another. That is, each separation wall is interposed between the terminal accommodating chambers 41 adjacent to each other in the terminal arrangement direction.

The separation walls include first separation walls 71 and second separation walls 72.

Each first separation wall 71 is interposed between the terminal accommodating chambers 41 that are adjacent to each other in the terminal arrangement direction and receive the wire-side terminals 20 without being shorted to each other. That is, the first separation wall 71 is at a position corresponding to a boundary between the shorting members 30A and 30B or between the shorting members 30B and 30C. Thus, each stage includes two first separation walls 71 in this embodiment.

Each second separation wall 72 is interposed between the terminal accommodating chambers 41 that are adjacent to each other in the terminal arrangement direction and into which the wire-side terminals 20 to be shorted by any of the bases 32A to 32C of the respective shorting members 30A to 30C are inserted respectively. That is, the second separation wall 72 is at a position between the first male terminal portions 34A belonging to the same shorting member 30A, between the first male terminals 34B belonging to the same shorting member 30B or between the first male terminals 34C belonging to the same shorting member 30. Thus, each stage includes five second separation walls 72 in this embodiment.

Each of the first and second separation walls 71, 72 includes an outer end 71*a*, 72*a*. This outer end 71*a*, 72*a* is an end (right end in FIGS. 1 and 2) defines an insertion entrance for the wire-side terminal 20. Thus, each outer end 71*a*, 72*a* defines the terminal insertion opening 41*a* of each terminal accommodating chamber 41.

Figure 5:
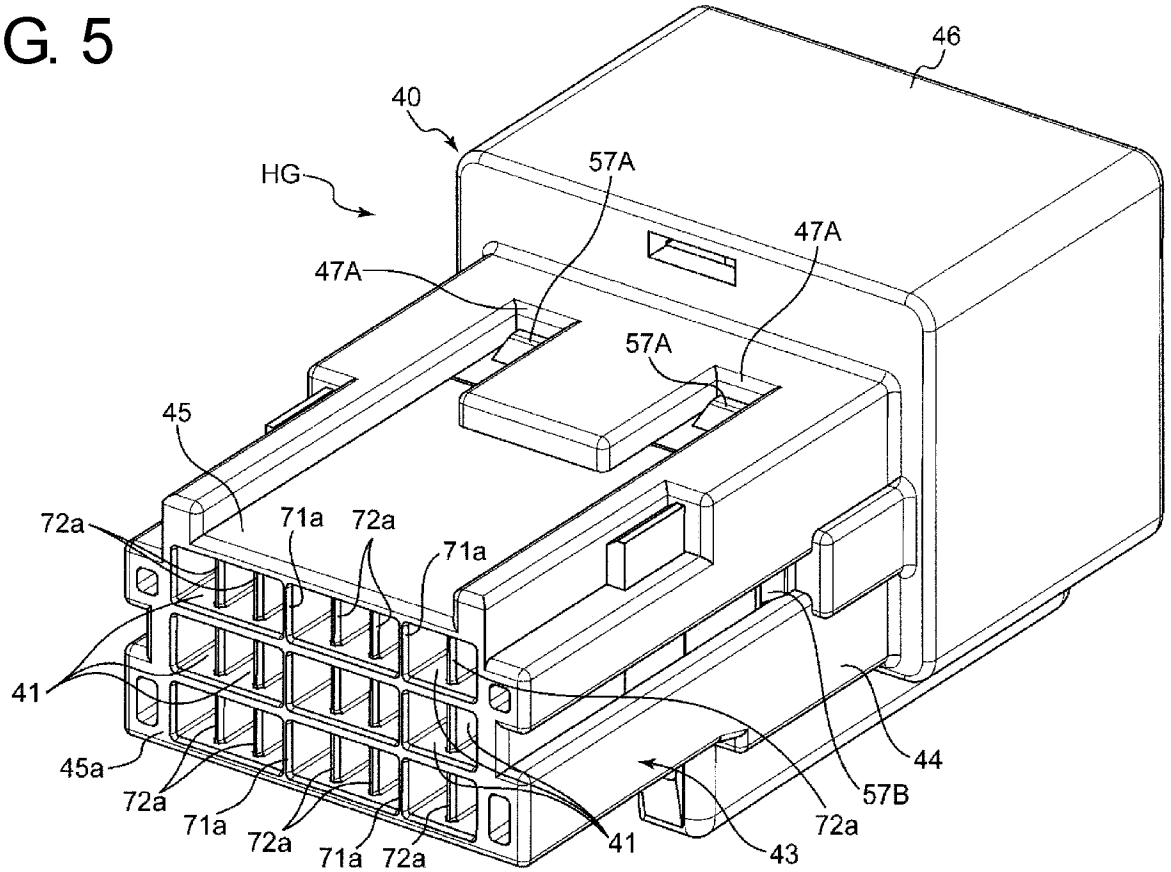
FIG. 5 is a perspective view of the joint connector viewed from the side of a terminal holding portion.
Figure 6:
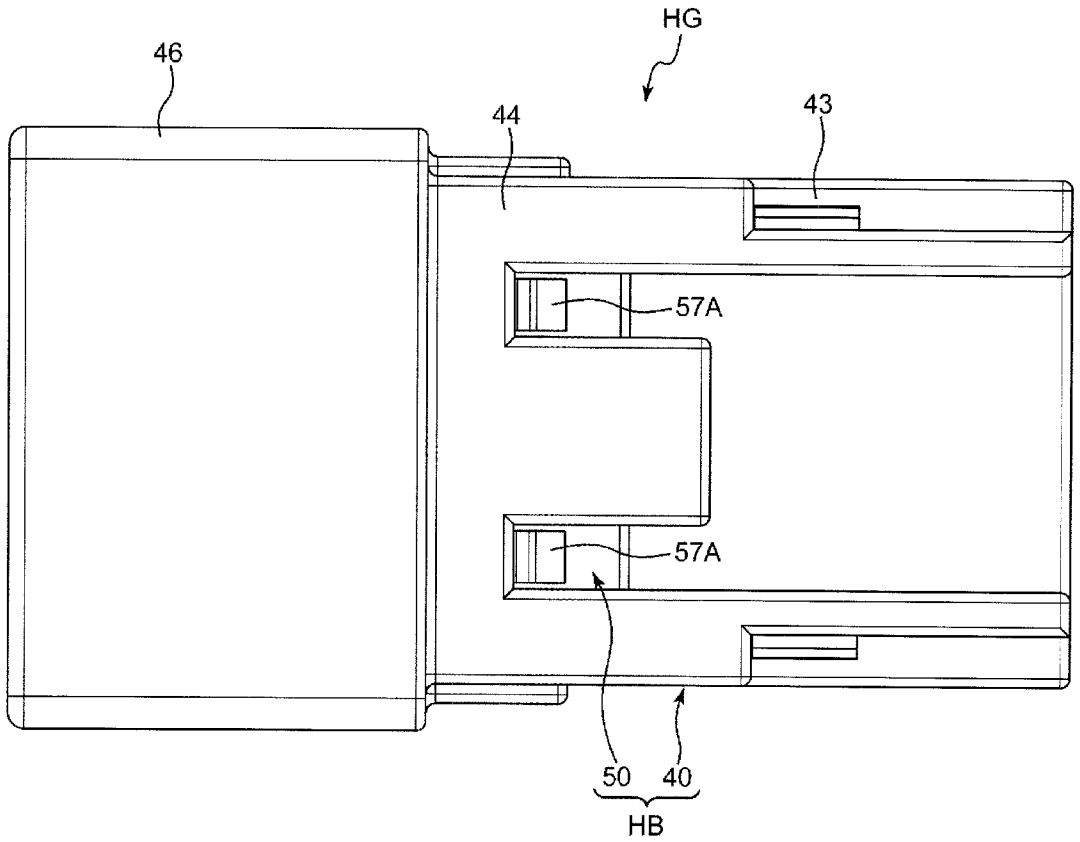
FIG. 6 is a plan view of the joint connector.
Figure 7:
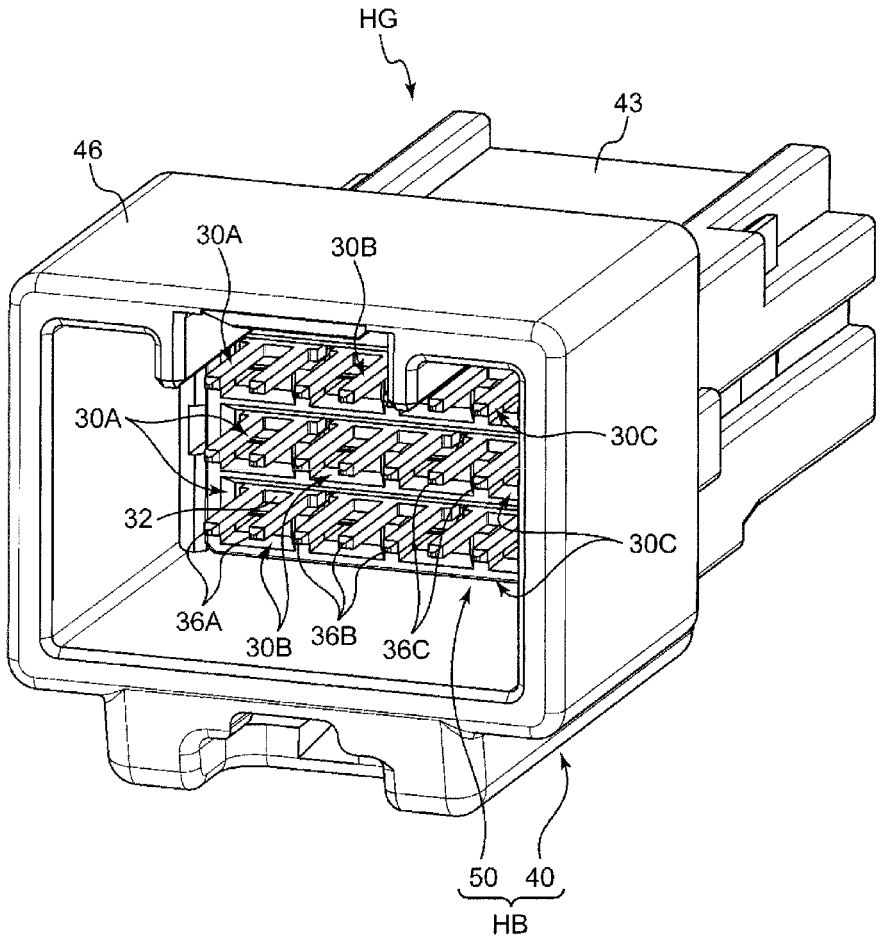
FIG. 7 is a perspective view of the joint connector viewed from the side of the receptacle.

As a characteristic feature of this joint connector, the first and second separation walls 71, 72 are shaped such that the outer ends 71*a* of the first separation walls 71 are different in appearance from the outer ends 72*a* of the second separation walls 72. Specifically, as shown in FIGS. 1, 2 and 5, a dimension of the second separation walls 71 in the terminal inserting direction is smaller than that of the first separation walls 71 in the terminal inserting direction so that the outer ends 72*a* of the second separation walls 72 are behind the outer ends 71*a* of the first separation walls 71*a* in the terminal inserting direction.

According to this joint connector, the specific wire-side terminals 20 can be shorted respectively via the bases 32A to 32C of the respective shorting members 30A to 30C and the wire-side terminals 20 to be fit to the first male terminals belonging to the different shorting members can be insulated from each other by inserting suitable wire-side terminals 20 into the respective terminal accommodating chambers 41 and fitting them to the first male terminals 34A, 34B or 34C on the back sides of the terminal accommodating chambers 41.

In this inserting operation, a worker who performs this insertion can distinguish the first and second separation walls 71, 72 by seeing the appearances of the outer ends 71*a*, 72*a* of the first and second separation walls 71, 72 defining the terminal insertion openings 41*a* of the respective terminal accommodating chambers 41 (positions of the outer ends 71*a*, 72*a* in the terminal inserting direction in this embodiment). Thus, the worker can insert proper wire-side terminals 20 into the respective terminal accommodating chambers without mistakes and avoid erroneous short-circuiting even if the respective terminal accommodating chambers 41 viewed from the outside of the insulating housing HG are arranged orderly regardless of the arrangement of the respective shorting members 30A to 30C in the connector conductor part. Specifically, the worker can distinguish the first separation walls 71 to be interposed between the wire-side terminals 20 to be insulated from each other and the second separation walls 72 to be interposed between the wire-side terminals 20 to be shorted to each other by seeing the outer ends 71*a*, 72*a*. Thus, a proper shorting circuit can be formed while reliably avoiding erroneous insertion by inserting the wire-side terminals 20 to be insulated from each other into each pair of the terminal accommodating chambers 41 having the first separation wall 71 interposed therebetween and inserting the wire-side terminals 20 to be shorted to each other into each pair of the terminal accommodating chambers 41 having the second separation wall 72 interposed therebetween.

In addition, the first and second separation walls 71, 72 can be distinguished based on an appearance difference between these outer ends 71*a*, 72*a*. Thus, a drastic increase of man-hours and the enlargement of the connector due to largely different intervals of the terminal accommodating chambers for distinction are not caused unlike a case where marking is applied to the outer surface of the insulating housing HG for distinction.

Further, in this first embodiment, as shown in FIG. 5, the outer ends 71*a* of the first separation walls 71 are on the same plane as an outer end 45*a* of the outer wall 45 to integrate the outer ends 71*a*, 45*a*, whereas the outer ends 72*a* of the second separation walls 72 are behind the outer end 45*a* of the outer wall 45 to provide steps between the outer ends 45*a* and 72*a*. This integration and these steps make the appearance difference of the outer ends 71*a*, 72*a* of the first and second separation walls 71, 72 notable and make the outer ends 71*a*, 72 easily distinguishable. In other words, the structure shown in FIG. 5 is advantageous in making the distinction easier as compared to a structure in which the both outer ends 71*a*, 72*a* are located behind the outer end 45*a* of the outer wall 45.

In the present invention, the appearance difference of the outer ends of the first and second separation walls is not limited to the one according to the first embodiment. For example, the positions of the outer ends 71*a*, 72*a* may be reversed in the terminal inserting direction. However, the shapes of the first and second separation walls 71, 72 according to the present invention preferably are made different so that the second separation walls have a lower insulating property than the first separation walls. The setting of such shapes enables the prevention of the above erroneous insertion by making the shape of the first separation walls and that of the second separation walls different without impairing an original function of the joint connector by relatively lowering the insulating property of the second separation walls interposed between the wire-side terminals to be shorted to each other than that of the first separation walls while maintaining a high insulating property of the first separation walls interposed between the wire-side terminals to be insulated from each other. For example, in the first embodiment, a high insulating property can be given to the first separation walls 71 by making the dimension of the first separation walls 71 in the terminal inserting direction larger, whereas the appearances of the outer ends 71*a*, 72*a* of the separation walls 71, 72 can be made clearly different by making the second separation walls 72 originally not required to have a high insulating property relatively smaller. Further, such shapes match the feeling of the worker seeing the outer ends 71*a*, 72*a* of the first and second separation walls 71, 72.

Figure 8:
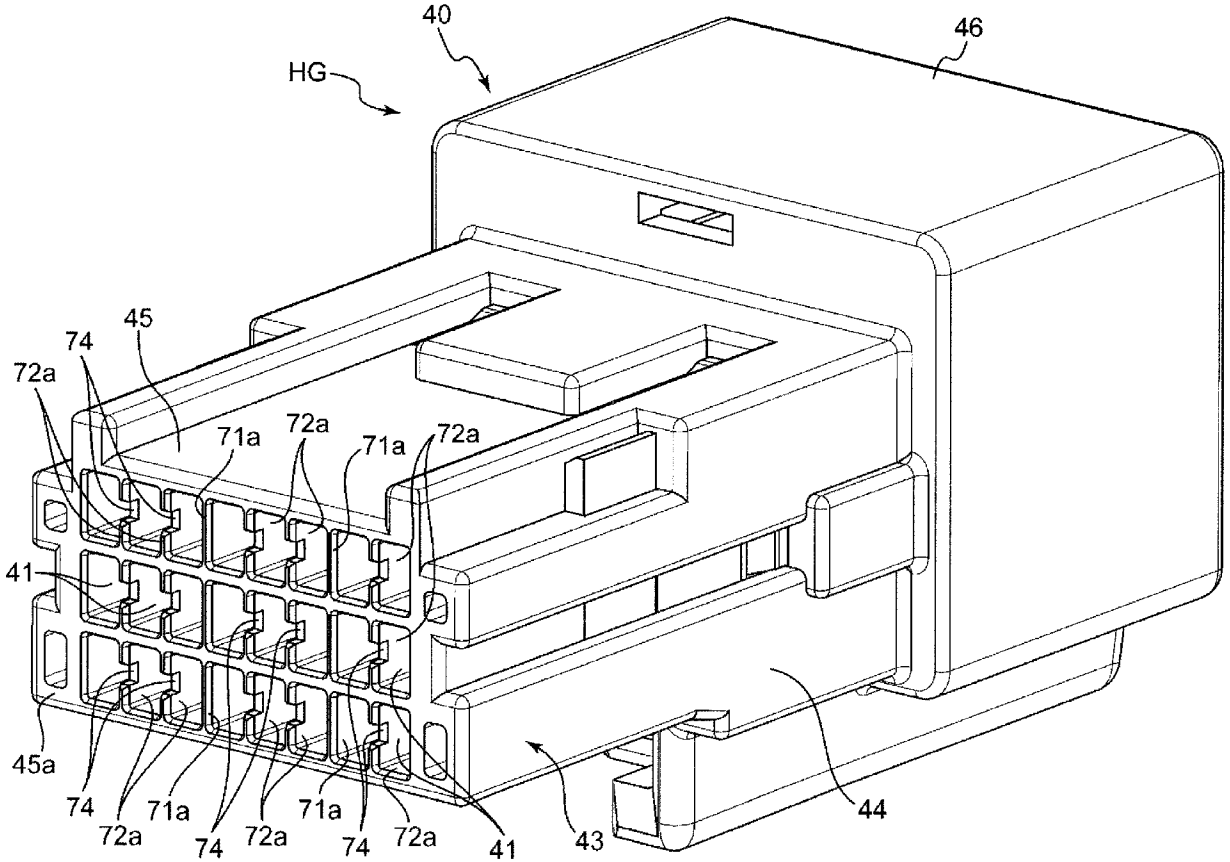
FIG. 8 is a perspective view of a joint connector according to a second embodiment of the present invention viewed from the side of a terminal holding portion.

This effect can be obtained by locating at least parts of the outer ends of the second separation walls behind the outer ends of the first separation walls. For example, as shown as a second embodiment in FIG. 8, outer ends 71*a*, 72*a* also can be made suitably different in appearance by forming cuts 74 extending rearward only in the outer ends 72*a* of second separation walls 72, i.e. by locating only parts of the outer ends 72*a* of the second separation walls 72 behind the outer ends 71*a* of the first separation walls 71.

Figure 9:
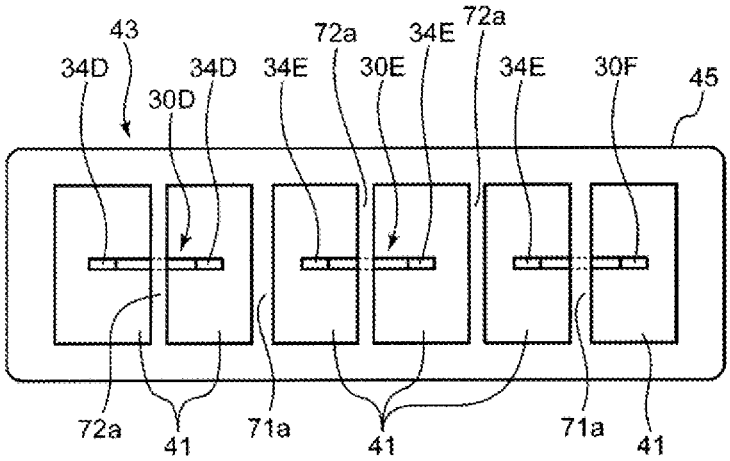
FIG. 9 is a front view of a joint connector according to a third embodiment of the present invention viewed from the side of a terminal holding portion.

As another mode, thicknesses, i.e. dimensions in the terminal arrangement direction of the outer ends may be made different, as a third embodiment in FIG. 9.

A connector conductor part according to this third embodiment includes a shorting member 30D having two male terminal portions (connector-side terminals) 34D, a shorting member 30E having three male terminals (connector-side terminals) 34E and a normal terminal 30F having only a single male terminal. These shorting members are held in an insulating housing HG while being arranged in this order in the terminal arrangement direction (lateral direction of FIG. 9). On the other hand, a terminal holding portion 43 includes an outer wall 45 and separation walls dividing an accommodation space enclosed by the outer wall 45 into plural terminal accommodating chambers 41 corresponding to the respective male terminals. The separation walls include first separation walls 71 and second separation walls 72. The first separation walls 71 are at positions corresponding to a boundary between the shorting members 30D and 30E and a boundary between the shorting member 30E and the normal terminal 30F. The second separation walls 72 are at positions between the male terminals 34D belonging to the same shorting member 30D and between the male terminals 34E belonging to the same shorting member 30E as in the first embodiment.

In this joint connector, the outer ends 71*a* of the first separation walls 71 and the outer ends 72*a* of the second separation walls 72 can be made visually clearly different in appearance while maintaining a high insulating property of the first separation walls 71 by making a thickness of the second separation walls 72 (at least a thickness of the outer ends 72*a*) smaller than that of the first separation walls 71 (at least a thickness of the outer ends 71*a*) as shown in FIG. 9. In this way, erroneous insertion of a wire-side terminal into each terminal accommodating chamber 41 can be prevented.

Further, in this third embodiment, a thickness difference matches the feeling of a worker. That is, the worker can easily recognize the presence of boundaries between the shorting members 30D and 30E and the normal terminal 30F by the thickness of the outer ends 71*a* of the first separation walls 71. Further, in this third embodiment, the above difference can be given without almost changing intervals between the terminal accommodating chambers 41 adjacent to each other and the entire connector is not drastically enlarged.

As illustrated in the normal terminal 30F of this third embodiment, the connector conductor part according to the present invention may include not only the male terminals to be connected electrically to the other male terminal portions via the shorting connecting portions, but also single male terminal portions not electrically connected to the other male terminal portions. Further, the number of the stages where the connector conductor parts are provided and the number of the connector terminal portions included in the connector conductor parts can also be arbitrarily set.

As described above, according to the present invention, a joint connector has a function of shorting specific wire-side terminals to each other provided on a plurality of wires and can prevent erroneous short-circuiting caused by erroneous insertion of the wire-side terminals without drastically enlarging the entire connector and leading to a drastic cost increase.

A joint connector is provided that is connected to wire-side terminals respectively mounted on a plurality of wires and has a function of shorting specific wire-side terminals to each other. This joint connector includes a connector conductor part to be connected electrically to each wire-side terminal, and an insulating housing for holding the connector conductor part and each wire-side terminal to be connected to the connector conductor part. The connector conductor part includes three or more connector-side terminals electrically connectable to the wire-side terminals by being fit to the wire-side terminals and arranged in a specific terminal arrangement direction, and a shorting connecting portion for connecting some of the connector-side terminal portions to each other to make the some connector-side terminal portions electrically conductive to each other. The insulating housing includes a conductor holding portion for holding the connector conductor part and a terminal holding portion for receiving and holding each wire-side terminal to be fit to each connector-side terminal of the connector conductor part. The terminal holding portion includes an outer wall enclosing an accommodation space for accommodating the wire-side terminals, and separation walls dividing the accommodation space inside the outer wall into plural terminal accommodating chambers into which the respective wire-side terminals are individually insertable, and each separation wall has an outer end defining a terminal insertion opening serving as an insertion entrance for the wire-side terminal. The separation walls include a first separation wall and a second separating wall. The first separation wall is interposed between the terminal accommodating chambers adjacent to each other and configured to respectively accommodate the wire-side terminals to be insulated without being shorted to each other. The second separation wall is interposed between the terminal accommodating chambers adjacent to each other and is configured to accommodate the wire-side terminals to be shorted to each other via the shorting connecting portion. The first and second separation walls are shaped to make an appearance of an outer end (e.g. position or shape of the outer end) of the first separation wall and that of an outer end of the second separation wall different.

According to this joint connector, a worker who inserts each wire-side terminal into each terminal accommodating chamber can distinguish the terminal accommodating chambers, into which the wire-side terminals to be shorted to each other have to be inserted, and the other terminal accommodating chambers by seeing the outer ends of the first and second separation walls defining the terminal insertion openings of the respective terminal accommodating chambers. Specifically, since the outer end of the first separation wall to be interposed between the wire-side terminals to be shorted to each other and the outer end of the second separation wall to be interposed between the wire-side terminals to be insulated from each other are different in appearance, the worker can distinguish the first and second separation walls. Thus, it can be known that the wire-side terminals to be insulated from each other are inserted into a pair of terminal accommodating chambers having the first separation wall interposed therebetween and the wire-side terminals to be shorted to each other are inserted into a pair of terminal accommodating chambers having the second separation wall interposed therebetween. In this way, erroneous short-circuiting of the wire-side terminals can be prevented without drastically enlarging the entire connector and leading to a drastic cost increase. Further, the above distinction is possible while all intervals between the terminal accommodating chambers adjacent to each other in the terminal arrangement direction are equal.

In this joint connector, the shapes of the first and second separation walls are preferably different such that the second separation wall has a lower insulating property than the first separation wall. Such shapes match the insulating properties required for the first and second separation walls. Specifically, since the second separation wall is interposed between the wire-side terminals to be shorted to each other unlike the first separation wall, the second separation wall is not required to have a high insulating property. Therefore a function as the joint connector is not impaired even if the insulating property of the second separation wall is lower than that of the first separation wall. In other words, the above erroneous insertion can be prevented by making the shape of the first separation wall and that of the second separation wall different without impairing the original function of the joint connector. Further, that the second separation wall interposed between the wire-side terminals to be shorted to each other is shaped to have a lower insulating property than the first separation wall interposed between the wire-side terminals to be insulated from each other matches the feeling of a worker who sees the outer ends of the first and second separation walls.

Specifically, preferably, at least a part of the outer end of the second separation wall is located behind the outer end of the first separation wall in the terminal inserting direction or a thickness of the outer end of the second separation wall is smaller than that of the outer end of the first separation wall. Examples of the former case include (1) a dimension of the second separation wall in the terminal inserting direction is smaller than that of the first separation wall in the terminal inserting direction so that the entire outer end of the second separation wall is located behind the outer end of the first separation wall in the terminal inserting direction and (2) a cut is provided only in the outer end of the second separation wall out of the outer ends of the first and second separation walls. Further, in the case (1), the outer ends of the first and second separation walls can be more easily distinguished by locating the outer end of the second separation wall behind an outer end of the outer wall to provide a step between the outer ends in the terminal inserting direction while locating the outer end of the first separation wall on the same plane as the outer end of the outer wall (i.e. both outer ends are integrated).

The invention claimed is:

1. A joint connector to be connected to a plurality of wire-side terminals respectively mounted on a plurality of wires and having a function of shorting specific wire-side terminals to each other out of the plurality of wire-side terminals, comprising:

a connector conductor part to be electrically connected to each wire-side terminal; and an insulating housing for holding the connector conductor part and each wire-side terminal to be connected to the connector conductor part, wherein:

the connector conductor part includes three or more connector-side terminal portions electrically connectable to the wire-side terminals by being fit to the wire-side terminals and arranged in a specific terminal arrangement direction, and a shorting connecting portion for connecting some of the connector-side terminal portions to each other, out of the plurality of connector-side terminal portions, to make the some connector-side terminal portions electrically conductive to each other;

the insulating housing includes a conductor holding portion for holding the connector conductor part and a terminal holding portion for receiving and holding each wire-side terminal to be fit to each connector-side terminal portion of the connector conductor part;

the terminal holding portion includes an outer wall enclosing an accommodation space for accommodating the plurality of wire-side terminals, and a plurality of separation walls dividing the accommodation space inside the outer wall into a plurality of terminal accommodating chambers into which the respective wire-side terminals are individually insertable, and each separation wall has an outer end defining a terminal insertion opening serving as an insertion entrance for the wire-side terminal; and the plurality of separation walls include a first separation wall interposed between the terminal accommodating chambers adjacent to each other and configured to respectively accommodate the wire-side terminals to be insulated without being shorted to each other, and a second separation wall interposed between the terminal accommodating chambers adjacent to each other and configured to respectively accommodate the wire-side terminals to be shorted to each other via the shorting connecting portion, and the first and second separation walls are shaped to make an outer end of the first separation wall and an outer end of the second separation wall different in appearance.

2. A joint connector according to claim 1, wherein the shapes of the first and second separation walls are different such that the second separation wall has a lower insulating property than the first separation wall.

3. A joint connector according to claim 2, wherein at least a part of the outer end of the second separation wall is located behind the outer end of the first separation wall in the terminal inserting direction.

4. A joint connector according to claim 3, wherein a dimension of the second separation wall in the terminal inserting direction is smaller than that of the first separation wall in the terminal inserting direction so that the outer end of the second separation wall is located behind the outer end of the first separation wall in the terminal inserting direction.

5. A joint connector according to claim 4, wherein the outer end of the first separation wall is located on the same plane as an outer end of the outer wall and the outer end of the second separation wall is located behind the outer end of the outer wall to provide a step between the both outer ends in the terminal inserting direction.

6. A joint connector according to claim 3, wherein a cut is provided only in the outer end of the second separation wall out of the outer ends of the first and second separation walls.

* * * * *